United States Patent [19]

McGuire

[11] Patent Number: 4,757,956

[45] Date of Patent: Jul. 19, 1988

[54] COLLAPSIBLE SPOOL HOLDER

[76] Inventor: Ruth F. McGuire, 1903 Foxcliff Drive North, Martinsville, Ind. 46151

[21] Appl. No.: 53,804

[22] Filed: May 26, 1987

[51] Int. Cl.[4] ..... B65H 49/00; B65H 49/16; B65H 49/32

[52] U.S. Cl. ..... 242/139; 211/59.1; 211/70; 211/132; 225/37; 225/77

[58] Field of Search ..... 242/139, 134, 137, 137.1, 242/140, 141, 146, 130, 129.5, 131; 225/37, 77; 223/106, 107; 224/162; 206/389, 391, 392, 403, 404, 405, 406; 211/13, 44, 59.1, 70, 195, 132

[56] References Cited

U.S. PATENT DOCUMENTS

| | | | |
|---|---|---|---|
| D. 244,323 | 5/1977 | Stone | 242/139 X |
| 760,365 | 5/1904 | Yates | 242/139 X |
| 1,037,148 | 8/1912 | Kamp et al. | 242/139 X |
| 1,153,062 | 9/1915 | Gourlay | 211/132 X |
| 1,367,685 | 2/1921 | Cohn | 242/139 |
| 1,758,707 | 3/1929 | Landsberg | 242/137 |
| 2,330,702 | 7/1941 | Goldschmidt | 242/139 |
| 2,402,696 | 6/1946 | Track | 242/139 |
| 3,021,093 | 8/1959 | Halpern | 242/134 |
| 3,305,190 | 8/1965 | Gans | 242/139 |
| 3,464,648 | 5/1968 | Fuhriman | 242/139 |
| 3,827,654 | 8/1974 | Armstrong | 242/146 |
| 4,036,418 | 7/1977 | Chlebda | 242/139 X |

*Primary Examiner*—Stanley N. Gilreath
*Attorney, Agent, or Firm*—Woodward, Emhardt, Naughton, Moriarty & McNett

[57] ABSTRACT

A collapsible spool holder. A pair of vertically spaced apart horizontally extending walls are telescopically inner-connected and mounted to a base and are arranged to move outwardly from the base to an erect position or to collapse into the base. Each horizontally extending wall along with the base include a plurality of upright rods each of which holds a spool of thread. A plurality of knife blades are mounted adjacent each rod to allow the thread to be severed from each spool without removal of the spool. A lid is removably mounted to and encloses the upright rods with spools.

5 Claims, 3 Drawing Sheets

COLLAPSIBLE SPOOL HOLDER

BACKGROUND OF THE INVENTION

This invention is in the field of containers for holding spools of line, and more specifically spools of sewing thread. Sewing containers or boxes are well known and are designed to hold the items necessary for sewing. Some of the prior containers include a plurality of upright rods for individually holding spools of thread. For example, the U.S. Pat. Nos. 4,036,418 issued to Chlebda; 3,464,648 issued to Fuhriman; 3,305,190 issued to Gans; 2,330,702 issued to Goldschmidt; and, 1,367,685 issued to Cohn disclose such designs. Other spool holding devices are disclosed in U.S. Pat. Nos. 1,758,707 issued to Landsberg and 3,021,093 issued to Halpern.

The typical sewing box includes many spools of thread of different sizes and colors necessitating a great amount of spool storage space. Thus, the prior containers are typically bulky having a number of layers having spool holders thereon. I have designed a collapsible spool holder allowing the convenient storage of the container when not in use, but which will telescope to an erect position allowing easy access to the individual spools.

In the event a length of thread is required from a spool mounted in the prior containers, it is necessary to remove the spool from the holder, sever the length of thread from the spool, and then remount the spool. In the event the individually removed spools of thread are not remounted, then the spools will become mixed and the lines of thread will become entangled creating a mess. I have designed a thread cutter mounted adjacent each spool of thread to alleviate the necessity of removal of the spool in order to sever a length of thread from the spool.

SUMMARY OF THE INVENTION

One embodiment of the present invention is a holder for spools of thread comprising a base restable upon a flat surface, a first spool holding structure movably mounted upon the base and including a plurality of individual spool holders to each removably hold a spool of thread, and, first telescopic structure cooperatively associated with the base and the first spool holding structure to allow the first spool holding structure to move vertically upward and downward relative to the base in telescopic fashion.

Another embodiment of the present invention is a storage unit for storing spools of line comprising a base, a structure telescopically mounted to the base and extendable therefrom when in a first state and collapsible therein when in a second state, a plurality of upright rods mounted on the structure to each hold a spool of line, and, a lock interacting between the base and the structure to lock the structure extended in the first state relative to the base to allow access to spools of line and to release the base and the structure to allow the structure with the upright rods to collapse into the base in the second state for storage of spools of line.

It is an object of the present invention to provide a new and improved holder for spools of thread.

Another object ofthe present invention is to provide a collapsible spool holder.

A further object of the present invention is to provide a spool holder having cutting means positioned to facilitate removal of line from the spool without necessitating removal of the spool from the holder.

Related objects and advantages of the present invention will be apparent from the following description.

DESCRIPTION OF THE PREFERRED EMBODIMENT

Figure 1:
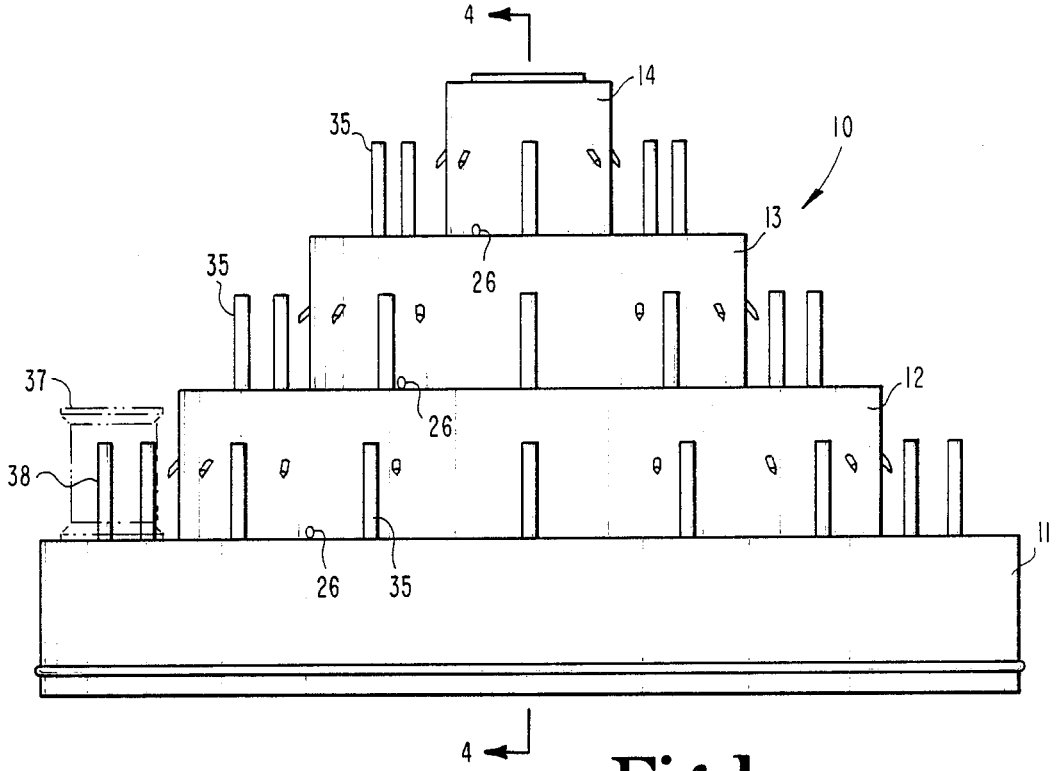
FIG. 1 is a side view of the spool holder incorporating the present invention in the erected position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a holder 10 for spools of thread. Holder 10 includes four downwardly opening walls 11, 12, 13, and 14 telescopically connected together to assume either the erected in use position shown in FIG. 1 or the collapsed storage position depicted in FIG. 2.

Figure 4:
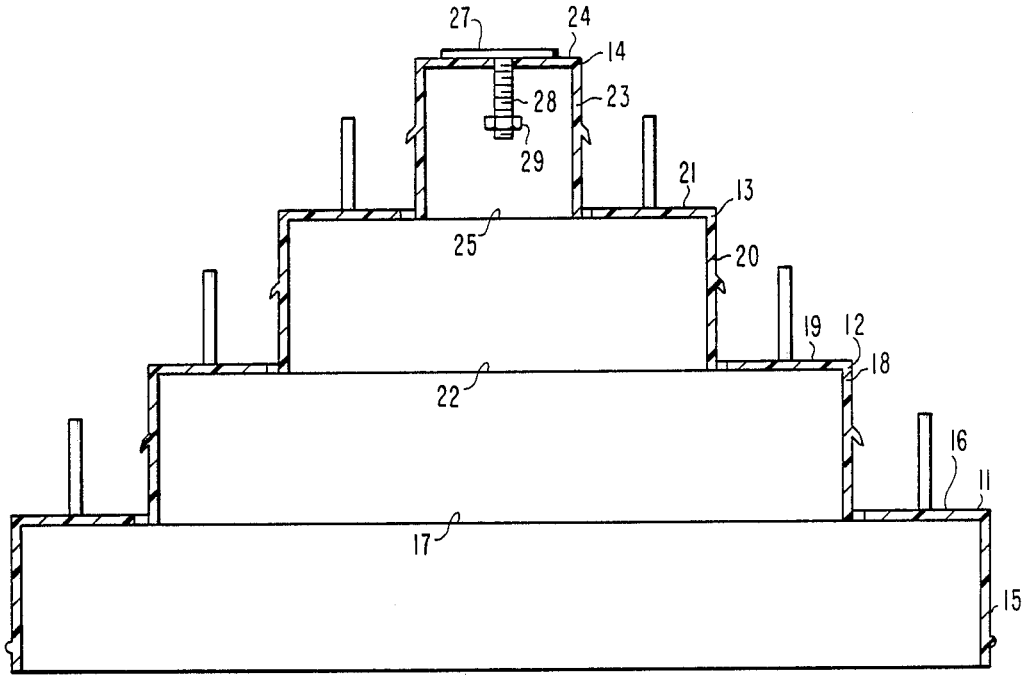
FIG. 4 is a cross-sectional view taken along a line and viewed in the direction of the arrows 4—4 of FIG. 1.

Wall 11 forms a base and includes a continuous cylindrical vertical side wall 15 (FIG. 4) integrally joined to a horizontal wall 16 having a central aperture 17 extending therethrough. Wall 12 likewise has a continuous, cylindrical, vertical side wall 18 integrally connected to a horizontal wall 19 which are sized to slide through aperture 17 to the collapsed state shown in FIG. 2. Thus, the outside diameter of wall 18 is less than the diameter of aperture 17. Wall 13 includes a continuous, cylindrical side wall 20 integrally joined to a horizontal wall 21 which are sized to slide through central aperture 22 provided in wall 19. Further, wall 14 includes a continuous cylindrical side wall 23 integrally joined to a top horizontal wall 24 both of which are sized to slidably extend through aperture 25 of wall 21 to allow all walls 11–14 to assume the collapsed position depicted in FIG. 2.

Each side wall 18, 20 and 23 include a plurality of projections 26 (FIG. 1) which extend slightly outwardly thereof to normally contact the upwardly facing surfaces respectively of horizontal walls 16, 19 and 21 to allow the walls to be locked together in the erected position. Projections 26 are sufficiently small to allow walls 12–14 to be forced downwardly with the projections passing the horizontal walls allowing the device to assume the collapsed position.

Figure 2:
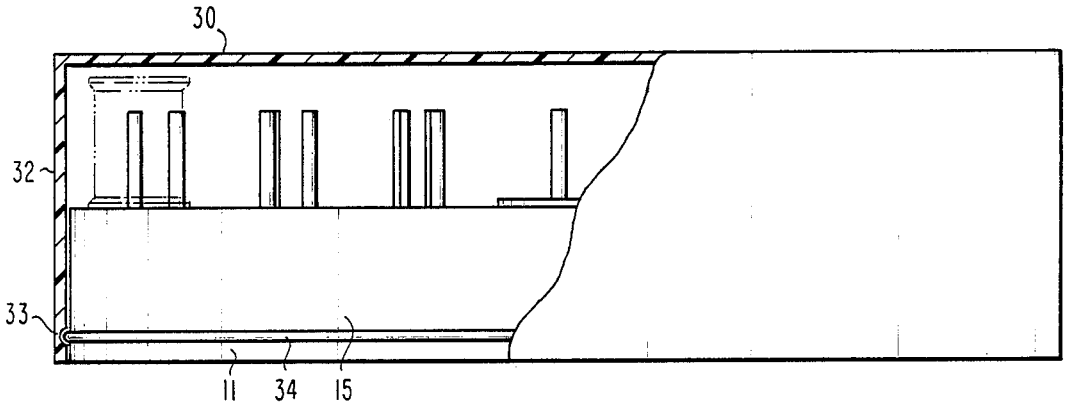
FIG. 2 is a side view of the spool holder of FIG. 1 only shown in the collapsed position and showing a fragmentary view of the lid mounted thereon.

A handle 27 has a threaded shank 28 extending through top wall 24 and in meshing engagement with a conventional nut 29 located therebeneath, but spaced from the top wall a sufficient distance to allow the head of handle 27 to be pulled upwardly when the holder is pulled from the collapsed position of FIG. 2 to the erected position of FIG. 1. When the handle is not in use, the head of the handle lies adjacent the top surface of top wall 24.

A lid 30 includes a horizontally extending top wall integrally joined to a continuous cylindrical depending wall 32 (FIG. 2) having a continuous interior groove 33 formed on the inwardly facing surface thereof. A continuous ridge 34 is formed on the outwardly facing surface of wall 15 of base 11 and interferingly reacts with wall 32 to fit into groove 33 thereby allowing the lid to be snapped onto and off of the collapsed spool holder. The upper surface of the top wall of the lid is flat allowing a variety of objects to rest thereon.

Figure 3:
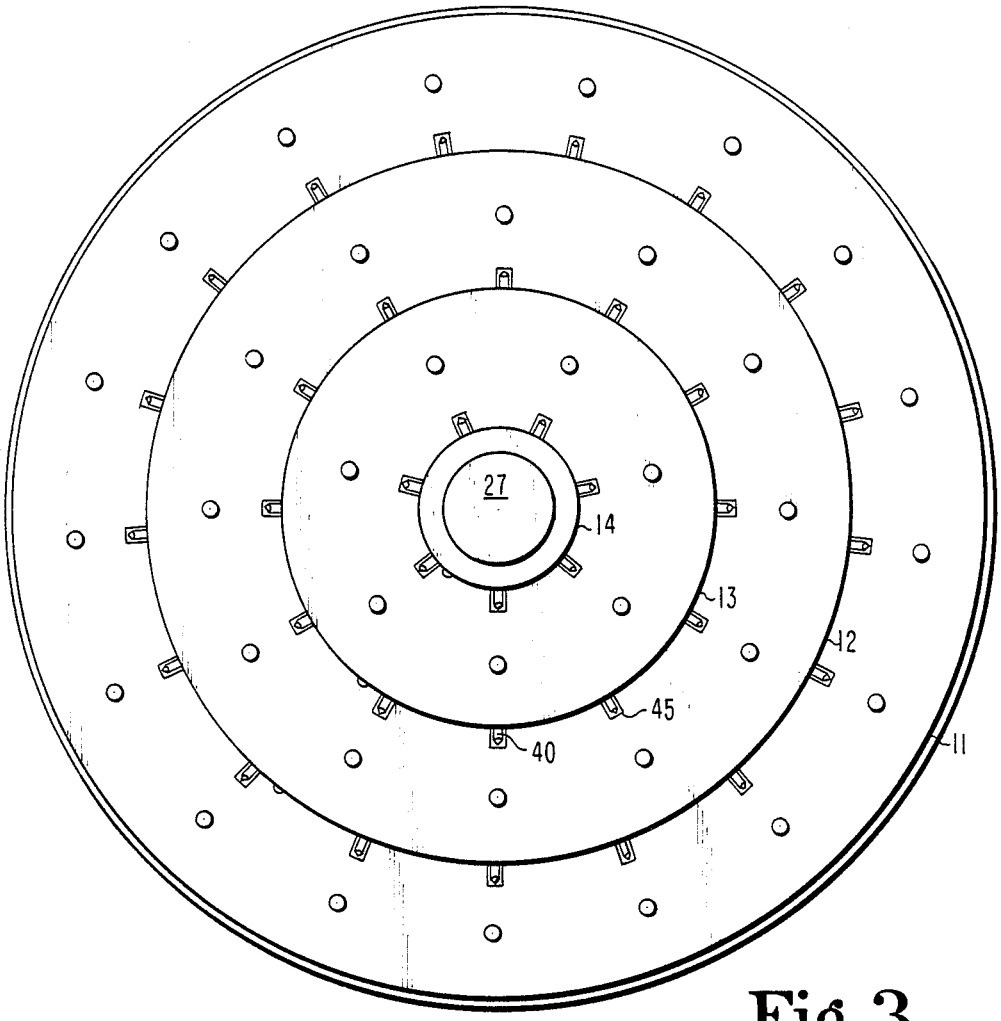
FIG. 3 is a top view of the holder of FIG. 1.

Walls 16, 19 and 21 each include a plurality of upright spool holders or rods 35. The rods are spaced apart sufficiently from the vertical walls 18, 20 and 23 to enable spools of thread to be mounted to each rod. For example, a spool of thread shown by dashed lines 37 is shown removably mounted to spool holder rod 38 (FIG. 1). Each rod has a sufficiently small outside diameter to fit into the central passage of the spool. The rods are arranged in a circular pattern (FIG. 3) enabling a great quantity of spools to be mounted to the holder.

Figure 5:
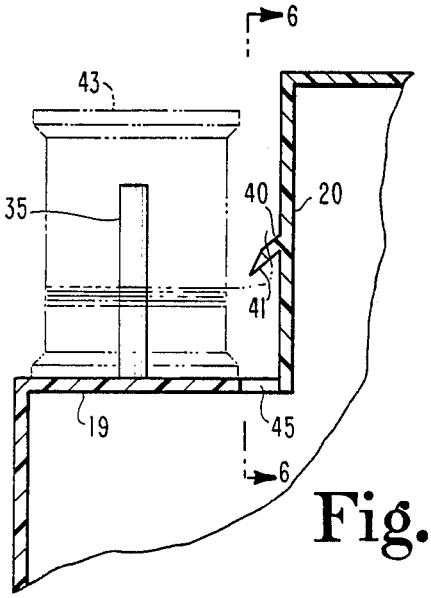
FIG. 5 is an enlarged fragmentary view of the spool holder showing one of the individual spool holding rods.
Figure 6:
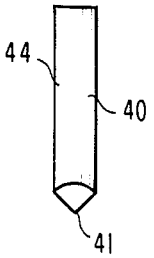
FIG. 6 is an enlarged view of one of the blades used to cut the thread looking in the direction of the arrows 6—6 of FIG. 5.

A separate blade or severing means is mounted to the vertical sidewall immediately adjacent each spool holder rod to allow severance of the thread from the spool without removal of the spool from the rod. For example, blade 40 is cantileveredly mounted to and extends out from wall 20 immediately adjacent upright rod 35 (FIG. 5). The lower edge 41 of blade 40 includes a sharp surface to sever the thread extending outwardly from spool 43. The upper rounded surface 44 of the blade is dull to prevent accidental injury to the user. Further, cutting surface 41 extends downwardly thereby minimizing accidental injury. Wall 19 is provided with a slot 45 immediately beneath blade 40 to allow the blade to pass through wall 19 as the holder is collapsed. Thus, in order to collapse the holder, the blades attached to wall 20 must be oriented with respect to the blade slots 45 provided on wall 19 and likewise the blades on walls 18 and 23 must be oriented with respect to the blade slots provided respectively on horizontal walls 16 and 21.

Wall 11 provides a base for the holder which is restable on a flat surface whereas wall 12 provides a first spool holding means which is movably mounted on the base and which includes a plurality of upright individual spool holders 35 to each removably hold a spool of thread. Walls 12 and 11 are telescopically constructed to allow the holder to move vertically upward to an extended position (FIG. 1) and downward to the collapsed position shown in FIG. 2. Additional spool holding means are provided by walls 13 and 14 and also are telescopically connected to the base.

It is anticipated that the entire holder will be produced from a material such as plastic. Many variations are contemplated and included in the present invention. For example, the device shown in the drawings may be utilized to hold not only spools of thread, but spools of other types of lines used in the auto, medical and health care fields. For example, spools of surgical thread may be readily mounted to the spool holders.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A storage unit for storing spools of line comprising:

a base with a plurality of passages;

a structure telescopically mounted to said base and extendable therefrom when in a first state and collapsible therein when in a second state;

a plurality of first upright rods mounted on said structure and a plurality of second upright rods mounted to said base to each hold a spool of line;

locking means interacting between said base and said structure to lock said structure extended in said first state relative to said base to allow access to spools of line and to release said base and said structure to allow said structure with said first upright rods to collapse into said base in said second state for storage of spools of line; and, a plurality of line cutters mounted to said structure and positioned near said second upright rods to allow line on spools of line to be severed, said line cutters positioned outwardly of said base to cut line when said structure is in said first state but each alignable with said passages to be positioned within said base when said structure is in said second state.

2. The storage unit of claim 1 wherein:

said line cutters include a plurality of knife edge members extending outwardly adjacent said second upright rods.

3. The storage unit of claim 2 wherein:

said knife edge members each have a lower edge with a sharp surface to sever line and an upper rounded dull surface.

4. The storage unit of claim 1 and further comprising:

a cover removably mounted to said base to enclose said first upright rods and said second upright rods with spools of thread thereon, said cover and said base have an interacting groove and ridge combination structure to allow said cover to be snapped onto and off of said base.

5. The storage unit of claim 1 wherein:

said base includes a horizontally extending wall and said structure includes a vertically extending side wall, said passages are radially extending slots in said horizontally extending wall and open toward said vertical wall which has said cutters mounted thereon.

* * * * *